US005499729A

United States Patent [19]

Greenwood et al.

[11] Patent Number: 5,499,729

[45] Date of Patent: Mar. 19, 1996

[54] INFANT FEEDING BOTTLE INCLUDING PRESSURE EQUALIZING DIAPHRAGM

[75] Inventors: Mark H. Greenwood, Arlington Heights; Marvin Keith, Evanston, both of Ill.

[73] Assignee: Children On the Go, Inc., Wheeling, Ill.

[21] Appl. No.: 214,614

[22] Filed: Mar. 15, 1994

[51] Int. Cl.[6] ..... A61J 9/04

[52] U.S. Cl. ..... 215/11.5; 137/845; 215/261; 215/271

[58] Field of Search ..... 215/11.1, 11.2, 215/11.3, 11.4, 11.5, 261, 260, 271; 220/89.1, 373, DIG. 27, 209; 222/875, 490; 137/845, 859

[56] References Cited

U.S. PATENT DOCUMENTS

| | | | |
|---|---|---|---|
| 297,174 | 4/1884 | Seymour . | |
| 1,732,126 | 10/1929 | Gardner . | |
| 1,827,100 | 10/1931 | Pardee . | |
| 2,084,099 | 6/1937 | Maccoy . | |
| 2,516,084 | 7/1950 | Wells | 137/845 |
| 2,529,794 | 11/1950 | Brown . | |
| 2,670,884 | 3/1954 | Swartz . | |
| 2,742,168 | 4/1956 | Panetti . | |
| 2,745,568 | 5/1956 | Newton . | |
| 2,753,063 | 7/1956 | Robinson . | |
| 3,530,979 | 9/1970 | Merrill, Jr. et al. | 215/11.6 X |
| 3,768,683 | 10/1973 | Van Den Bosch . | |
| 3,811,466 | 5/1974 | Ohringer | 137/845 |
| 4,010,861 | 3/1977 | Wetten | 215/11.5 |
| 4,176,678 | 12/1979 | Marchiax et al. | 137/845 |
| 4,637,934 | 1/1987 | White . | |
| 4,646,945 | 3/1987 | Steiner et al. | 137/845 |
| 4,685,577 | 8/1987 | Chen | 215/11.5 |
| 4,728,006 | 3/1988 | Drobish et al. | 137/859 |
| 4,730,744 | 3/1988 | Vinciguerra . | |
| 4,865,207 | 9/1989 | Joyner et al. | 215/11.5 |
| 4,979,629 | 12/1990 | Askerneese . | |
| 5,005,737 | 4/1991 | Roho | 137/845 |
| 5,033,631 | 7/1991 | Nightingale . | |
| 5,071,017 | 12/1991 | Stulj | 220/89.1 X |
| 5,109,996 | 5/1992 | Sullivan . | |
| 5,213,236 | 5/1993 | Brown et al. | 220/89.1 X |
| 5,339,971 | 8/1994 | Röhrig | 215/11.5 |

FOREIGN PATENT DOCUMENTS

| | | | |
|---|---|---|---|
| 57694 | 2/1913 | Germany | 215/11.5 |

*Primary Examiner*—Allan N. Shoap
*Assistant Examiner*—Christopher J. McDonald
*Attorney, Agent, or Firm*—Olson & Hierl, Ltd.

[57] ABSTRACT

An infant feeding bottle that is nipple-equipped at one end that is further equipped with a pressure equalizing apertured diaphragm member at the opposite end. The diaphragm member allows room air to pass therethrough into the air space in the bottle when the bottle is inclined and liquid is withdrawn through the nipple, thereby equalizing the interior air pressure. The diaphragm member is gas and liquid tight when the inside and outside pressures are equal and the bottle is in an upright configuration with the feeding liquid resting on the diaphragm member. The diaphragm member has a central portion which is dome configured and provided with apertures that are in a sealed shut configuration when the diaphragm member is relaxed yet that are opened when the diaphragm member is expanded responsive to differential air pressure.

18 Claims, 3 Drawing Sheets

PRIOR ART

INFANT FEEDING BOTTLE INCLUDING PRESSURE EQUALIZING DIAPHRAGM

FIELD OF THE INVENTION

This invention relates to infant feeding bottles equipped with internal air pressure equalizing means that operates during liquid withdrawal.

BACKGROUND OF THE INVENTION

The feeding of an infant from a nipple-equipped, hard-walled bottle often results in air intake by the infant. The air intake occurs when air passes through the nipple orifice during feeding to equalize the reduced air pressure inherently occurring within the bottle as the liquid is removed. Air intake by the infant can cause discomfort, and, when this intake becomes excessive, can produce colic-like symptoms.

One infant feeding system that now is in common use employs thin plastic bags which collapse during feeding so that minimal air intake occurs. This system, however, is considered by some to be undesirable because it requires the replacement of the plastic bag for each feeding since the bag is not readily sterilizable after each use.

Various pressure equalizing valve-like means for use in association with hard-walled infant feed bottles have previously been proposed with the objective of reducing air intake by an infant.

However, so far as now known, all such previous valved bottle proposals have not met the basic criteria needed for general commercial practicality, such as:

1) equalizing internal bottle air space pressure at a rate which is substantially equal to the rate at which the internal pressure changes as liquid is withdrawn; and 2) achieving a substantially liquid-tight seal (without weeping) when a bottle containing a feeding liquid is placed in a (temporary) upright storage (or resting) position.

In addition, such a bottle must be fully sterilizable, capable of repeated reuse and resterilization, reliable, simple and capable of manufacture at a low cost.

A substantial and long-felt need exists in the infant feeding bottle field for a practical valved, hard-walled bottle structure. The present invention is believed to meet both the foregoing criteria and this need.

SUMMARY OF THE INVENTION

More particularly, this invention relates to a new and very useful improved bottle structure which is provided with an elastomeric apertured diaphragm means that is elastomerically responsive to differential gas pressure between the pressure of the air space in the bottle interior and the exterior air pressure. The diaphragm permits air to pass in one selected direction in response to such differential pressure, thereby to equalize gas pressure between the bottle structure interior and the external gaseous environment.

The bottle structure is particularly useful for infant feeding.

The invention also relates to a new and improved method of avoiding a bottle interior gas pressure differential relative to exterior gas pressure, such as occurs during withdrawal of liquid from the bottle.

The invention further relates to the elastomeric apertured diaphragm itself as an article of manufacture.

In an infant feeding bottle structure there is incorporated as a bottle body a walled housing (preferably longitudinally elongated) having an aperture at each opposite end. These apertures are each provided with a circumferentially extending threaded lip region.

Two rim-threaded caps are provided, one for association with each respective threaded lip region. Each cap includes a hole means in a mid-region thereof.

Nipple means outwardly extends from association with one cap, and the elastomeric apertured diaphragm means is inwardly centrally extendable from the other cap, relative to the bottle.

Preferably, the apertured diaphragm is thickened and centrally dome-configured. The apertures are closed and sealed shut when the diaphragm is relaxed, but the apertures open when the diaphragm is expanded responsive to applied gas pressure differentially applied to one side thereof, particularly the concave side of the dome.

By orienting a dome-configured diaphragm so that the dome is concave when viewed externally to the assembled bottle, the diaphragm is better enabled to maintain its apertures in a sealed shut configuration when the bottle is upright with liquid resting on top of the diaphragm.

Preferably, the apertures in the diaphragm are comparable to punctures and can be pointed or slit-like in configuration. The diaphragm can be thickened and can have dish-like depressions about the apertures on the concave surface portions of the diaphragm. The apertures open when the diaphragm is expanded by differentially applied gas pressure.

Preferably, the bottle components are separatable, comprised of plastic, and sterilizable in boiling water.

The elastomeric apertured diaphragm, particularly when thickened and domed, is believed to be a new and nonobvious structure having utility as a check-valve type of structure.

Other and further objects, aims, features, purposes, advantages, embodiments, applications and the like will be apparent to those skilled in the art.

DETAILED DESCRIPTION

Figure 1:
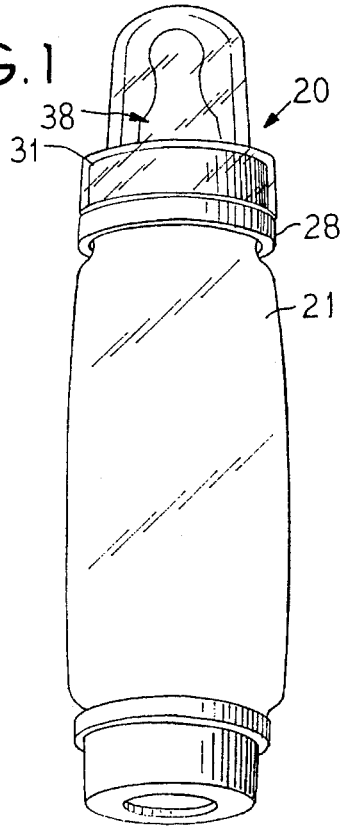
FIG. 1 is a perspective view of one embodiment of an infant feeding bottle structure of the present invention.
Figure 2:
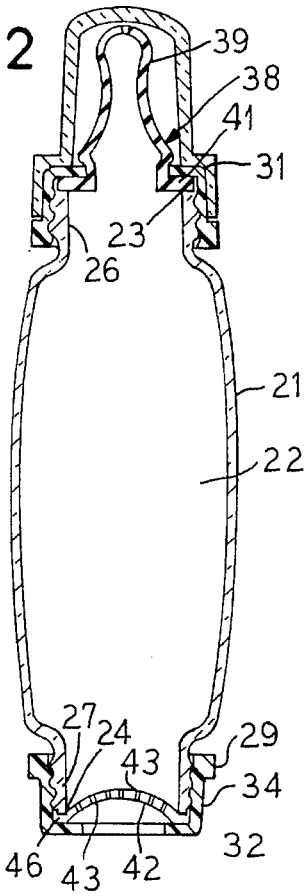
FIG. 2 is an axial sectional view taken through FIG. 1.
Figure 3:
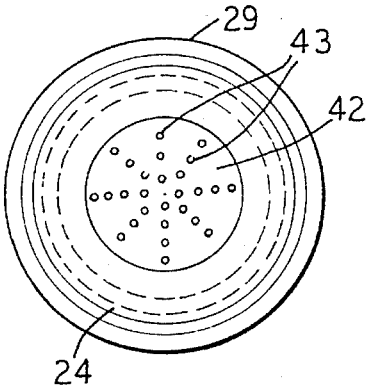
FIG. 3 is a enlarged diagrammatic bottom plan view of FIG. 1.

Referring to FIGS. 1–3, there is shown one embodiment 20 of an infant feeding bottle structure of this invention. The bottle structure 20 incorporates a continuously extending walled housing 21 that defines therein a cavity 22 and that is axially (or longitudinally) elongated; however, the housing can have any convenient or desired configuration. Walled housing 21 has an opening 23 and 24 defined at each of a pair of opposed housing ends. Each opening 23 and 24 has an adjacent cylindrically configured, circumferentially extending, threaded lip region 26 and 27, respectively. The threading is preferably external (as shown), but could be internal, if desired.

The infant feeding bottle structure 20 employs two cap members 28 and 29. Each cap member 28 and 29 has a circumferentially extending rim edge region 31 and 32 and a threaded rim region adjacent portion or flange 33 and 34 that is threadably matingly engageable with a different respective one of the threaded lip regions 26 and 27.

Thus, the arrangement is such that the flanges 33 and 34 are preferably internally threaded, as shown, but an externally threaded arrangement (not shown) could be used, if desired. Each cap member 28 and 29 has a hole 36 and 37 defined generally in a mid-region thereof. Preferably, (as shown), in embodiment 20, the cap member 28 and 29 and the lip regions 26 and 27 are each identical in respective configurations so that the cap members 28 and 29 are interchangeable.

Each cap member 28 and 29 preferably is associated with means for achieving a rim edge sealing engagement with the adjacent edge of lip region 26 and 27 when each respective cap member 28 and 29 is fully threadably engaged with each so-engaged lip region 26 and 27. Bottle structure 20 incorporates an outwardly extending nipple member 38 that has a nipple 39. The rear of nipple member 38 has circumferentially extending, radially outwardly projecting edge portions 41 that are sealingly associatable within one cap member. For example, in cap member 28, edge portions 41 are adjacent the hole 36. When cap member 28 is fully threadably engaged with its associated lip portion (here lip region 26), the nipple 39 extends through hole 36 and edge portions 41 are sealingly positioned between cap member 28 and lip region 26.

Preferably, and as shown, in the bottle of FIGS. 1–3, the edge portions 41 of nipple member 38 seat within the cap member 28 and the nipple 39 extends through the hole 36 thereof. Preferably, the nipple member 38 edge portions 41 comprise the preferred means for sealingly engaging the cap member 28 relative to the adjacent lip region 26. However, other sealing arrangements can be used, if desired.

The bottle structure 20 incorporates a thickened elastomeric diaphragm member 42 having a plurality of apertures 43 that extend therethrough. The diaphragm 42 has circumferential edge portions 46 that are sealingly associatable within the other one of said cap members, here cap member 29, so as to be axially adjacent the hole 37 thereof when cap member 29 is fully threadably engaged with its associated lip region 27. The apertures 43 are in a sealed shut configuration when the diaphragm member 42 is relaxed and are in an open configuration when the diaphragm member is expanded responsive to applied gas pressure.

The diaphragm can be flattened, but preferably (as shown), the diaphragm member 42 has a dome-configured central portion 44 with opposed concave and convex faces. Here, the apertures 43 are in the central portion 44.

Preferably, and as shown, the edge portions 46 of the diaphragm member 42 seat within the other cap member 29 with the diaphragm member 42 oriented so that the central portion 44 is concave when viewed from the exterior of the bottle structure 20. Preferably, the diaphragm member 42 edge portions 46 comprise the preferred means for sealingly engaging the other cap member 29 relative to the adjacent lip region 27. However, other arrangements and configurations can be used, if desired.

Figure 5A:
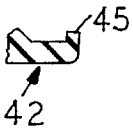
FIG. 5A is fragmentary view of the edge region of the diaphragm shown in FIG. 5 but including a modification.
Figure 5:
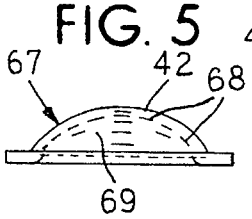
FIG. 5 is a diametrical vertical sectional view taken generally along the line V—V of FIG. 4.
Figure 4:
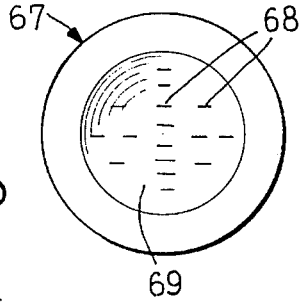
FIG. 4 is a top plan view of an alternative embodiment of the diaphragm member employed in the bottle structure of FIGS. 1–3.
Figure 7:
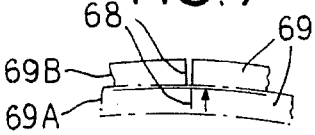
FIG. 7 is a fragmentary vertical sectional view taken along the line VII—VII of FIG. 6.
Figure 6:
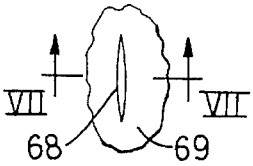
FIG. 6 is an enlarged fragmentary plan view of a single diaphragm aperture in an expanded diaphragm such as shown in FIGS. 5 and 6.

An alternative diaphragm member 67 adapted for use in bottle structure 20 is shown in FIGS. 4 and 5. Diaphragm member 67 has a domed central portion 69 and apertures 68 that have a slit-like configuration. When the diaphragm member 67 is expanded by applied gas pressure, the slit-like aperture 68 configuration has a characteristically has a relatively large cross-sectional open area. Thus, when diaphragm member 67 is expanded by gas pressure applied against the concave side of central portion 69 (as illustrated by the arrow shown in FIG. 7), a single aperture 68 can have a configuration as shown in FIGS. 6 and 7.

Preferably, each of the housing 21, the cap members 28 and 29, nipple member 38, and the diaphragm member is separatable from the others thereof.

Moreover, each of the housing 21, the cap members 28 and 29, the nipple member 38 and the diaphragm member 42 is preferably sterilizable with boiling water.

Preferably, each of the housing 21, the cap members 28 and 29, the nipple member 38 and the diaphragm member 42 is comprised of molded plastic with the housing 21 and the cap members 28 and 29 being relatively rigid and with the nipple member 38 and the diaphragm member 42 being flexible and elastomeric. Suitable relatively rigid plastics include polyesters, polyamides, polyolefins, polyimides, polycarbonates, polyacrylates, polyurethanes and the like. A present preference is for the diaphragm to be comprised of a moldable silicone elastomer. Preferably, the housing 21 is comprised of a transparent plastic.

The relationship between the components of bottle structure 20 is preferably such that when (a) the diaphragm member 42 is oriented in association with bottle 20 so that the central portion 44 is externally concave, (b) the bottle 20 contains an aqueous liquid (not shown) and (c) the bottle 20 is oriented with the nipple 39 uppermost and the diaphragm member 42 bottommost, the liquid does not pass through the apertures 43 (and similarly for diaphragm 67). However, when the bottle 20 is reoriented so that the nipple 39 is bottommost, an air space (not shown) that exists in the bottle 20 is adjacent to the diaphragm member 42. As the liquid is withdrawn from the bottle 20 through the nipple 39, the diaphragm member 42 expands slightly into the cavity 22 and concurrently the apertures 43 open so that the outside air passes through the apertures 43 and equalizes the air pressure in the interior air space compared to the pressure of the outside air (and similarly for diaphragm 67).

In one preferred form, the diaphragm 42 is optionally provided with a peripheral upstanding (on the dome 44 side) slight lip or flange 45, such as shown in FIG. 5A. The flange 45 can extend over the edge of lip region 27. Thus, the diaphragm 42 will then remain in place in the assembled bottle structure 20 even when an abnormal amount of pressure is applied against the concave surface of diaphragm 42. Without such a lip 45, the diaphragm 42 may possibly undesirably disengage from the assembled bottle 20 configuration shown in FIG. 2 when sufficient pressure is applied against the concave face of diaphragm 42 so that diaphragm 42 becomes pushed into the interior of the housing 21.

Conveniently and preferably, a diaphragm member particularly in its domed central region (if present) has a thickness in the range of about 0.05–0.3 inch (or about 0.13 to 0.76 centimeter). Other diaphragm thickness can be used, if desired. A diaphragm member is pressure responsive and has good elastomeric resiliency. Thus, after expansion and aperture opening followed by subsequent contraction and aperture closing, the apertures are effectively in sealed shut positions when the diaphragm member is in its relaxed configuration. The optimized diaphragm thickness and elasticity characteristics are variable and dependent upon many variables so that a single diaphragm thickness value cannot be stated.

Preferably, a diaphragm member has a cross-sectionally circular central (or spherical segment) domed configuration, and preferably the ratio of the height of the dome relative to the diameter of the dome is in the range of about 1:1 to about 1:4, but other ratios and other dome curvatures can be used, if desired.

The present invention provides in one aspect a process for equalizing gas pressure in the interior gas space of a bottle or container relative to exterior (or environmental) gas pressure; for example, as liquid in the oriented container is being withdrawn through a discharge aperture of the container that is remotely situated relative to the functional position of the diaphragm in the container wall.

This process involves the steps of first preliminarily associating the diaphragm with the wall region of the container at a location thereof that is adjacent to the container interior gas space when the container subsequently is in a predetermined orientation. This diaphragm is preferably concave relative to the side thereof against which increased gas pressure is anticipated to occur. This diaphragm preferably has a configuration or structure such as described herein.

In a second step, the container is so oriented and the relationship between the liquid and the gas in the container is changed, as by withdrawing liquid from the container. Thus, a differential gas pressure occurs between interior gas and exterior gas, and gas under the higher pressure passes through the diaphragm apertures and so equalizes the gas pressure existing on each side of the diaphragm.

When bottle structure 20 is charged with a liquid (not shown), such as milk (or other similar infant foods), and the delivery cap 28 with its associated nipple member 38, and also the bottom cap 29 with its associated illustrative elastomeric diaphragm member 67 (see, for example, FIGS. 4–7) are both threadably and sealingly associated with respective opposed openings 23 and 24 of the housing 21 (as shown in FIGS. 1 and 2), the bottle 20 is ready for use in infant feeding.

As the infant withdraws milk through nipple 39 with the assembled bottle structure 20 inverted, a partial vacuum is produced in the air space (not shown) in bottle 20 between the liquid level (not shown) and the diaphragm member 67. This vacuum results in a pressure differential that causes mainly the central portion 69 of the diaphragm member 67 to distend slightly and axially into the bottle 20 interior. The relaxed configuration of central portion 69 is shown illustratively in FIG. 7 as 69A and the distended configuration of central portion 69 is shown illustratively in FIG. 7 as 69B. In the distended configuration 69B, a plurality of slit apertures 68 (one shown in each of FIGS. 6 and 7, but see FIG. 4, for one example of aperture 68 arrangement) that extend through the diaphragm member 67 are each open (or spread, see, for example, FIGS. 6 and 7), thereby permitting air to pass through the diaphragm member 67 and equalize the pressure in the interior air space within cavity 22. When the air pressure is equalized, the diaphragm member 67 returns to its relaxed configuration where the slit channels or apertures 68 are effectively sealed and remain closed against passage of air and liquid through the diaphragm member 67.

Thus, the diaphragm member 67 and the slit apertures 68 cooperate like check valves allowing one-way movement of gas through diaphragm member 67 for normalizing air pressure in the bottle 20 without loss of liquid from the bottle 10 interior through diaphragm member 67 when the bottle is oriented in an upright position with liquid contacting interior surface portions of the diaphragm member 67. In effect, the weight of the liquid in the bottle 20 helps to keep the slit apertures.68 sealed shut and closed owing to the dome configuration of the central portion 69.

The bottle 20 has associated additional features including the capability for easy and thorough cleanability and also for indefinite reusability. While a present preference is for the bottle 20 to have longitudinal symmetry so that the opposite ends can use interchangeable end caps 11 and 13, asymmetrical configurations are possible as when one desires to have the base to be larger than the top for reasons of bottle standing stability or the like.

Figure 8:
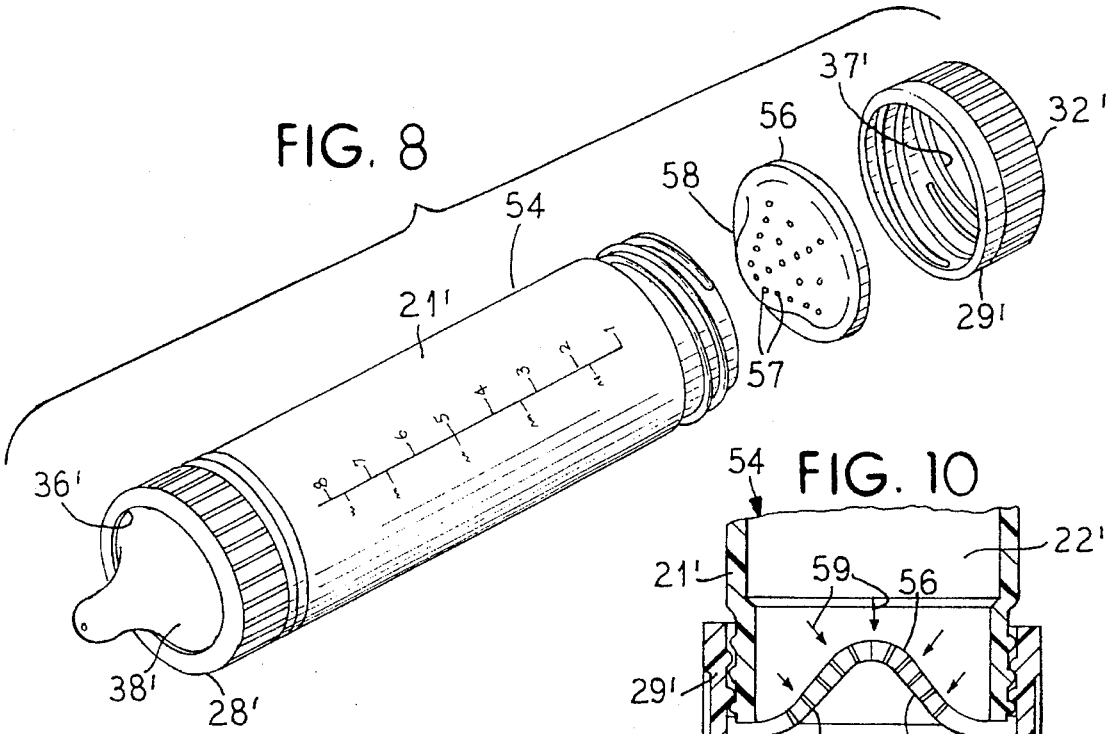
FIG. 8 is a view similar to FIG. 1, but showing another embodiment of an infant feeding bottle structure of the present invention in an inclined orientation, this view showing the bottom end assembly in an exploded form.
Figure 10:
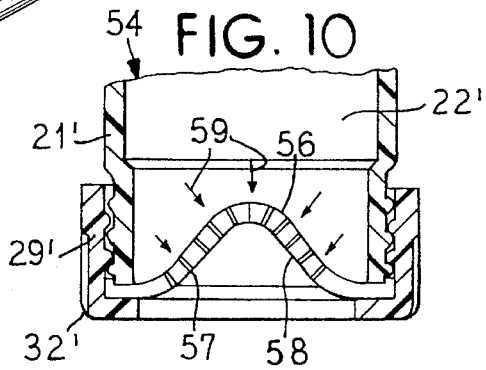
FIG. 10 is a fragmentary, enlarged axial sectional view taken through the bottom region of the bottle structure of FIG. 8.
Figure 9:
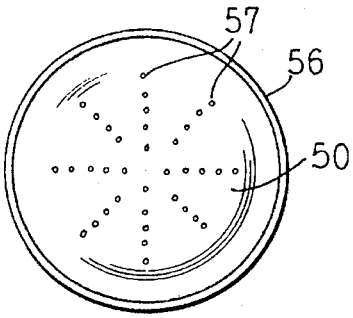
FIG. 9 is an enlarged top plan view of the diaphragm employed in the bottle structure of FIG. 8.

FIGS. 8–10 show another embodiment 54 of an infant feeding bottle structure of the present invention. Components of bottle structure 54 which are similar in structure and function to corresponding components of bottle structure 20 are similarly numbered, but with the addition of prime marks thereto for identification purposes. Bottle structure 54 has a fluid volumetric metering scale 55 that axially extends along one side of the housing 21'.

Bottle structure 54 employs a diaphragm member 56 which has a plurality of apertures 57 that are arranged slightly differently from the apertures 43 of diaphragm member 42. Also, diaphragm member 56 has a different dome configuration in its central portion 58 compared to diaphragm 42.

Although the apertures 57 and the apertures 43 are shown in their respective Figures as dots for present illustrative purposes, it will be appreciated that in fact these apertures 57 and 43 are in the nature of point punctures that extend transversely through their respective diaphragms 56 and 42. When such apertures 57 and 43 are not in an open configuration, but rather are in a closed configuration with their associated diaphragms 56 and 42 relaxed, such apertures 57 and 42 may not be visible to the eye.

When, like bottle structure 20, bottle structure 54 is in the upright configuration shown fragmentarily in FIG. 10, and a liquid (not shown) is present therein, the weight of this liquid exerts downwardly exerted gravitational forces on the diaphragm member 56 as shown by the illustrative arrows 57. The apertures 57 are in a sealed shut configuration when the diaphragm member 56 is initially in a relaxed configuration owing to the fact that pressures inside the chamber or cavity 22' and outside (exteriorly) are substantially equal. The downward forces associated with the liquid in the bottle 54 that are exerted upon the region of the central portion 58 (where the apertures 57 are located) operate to push downward slightly the central portion 58. This action effectively urges the apertures 57 into an enhanced sealed shut configuration that is desirable for purposes of avoiding any passage of the liquid through the apertures 57 as by weeping or the like. The effect is believed to be enhanced by the inwardly concave configuration of the central portion 58 of the diaphragm member 56, as compared, for example, to the situation which would exist if the diaphragm 56 where flat (i.e., did not have the domed configuration) or, for another example, if the diaphragm member 56 was inverted from the position illustrated (not shown).

When bottle structure 54 is inverted from the upright configuration shown in FIG. 10 into a position or orientation, such as illustrated, for example, in FIG. 8 (with the bottle 54 assembled and charged with liquid) and the liquid is being withdrawn through nipple 39, the interior pressure in the air space (not shown) in the bottle 54 decreases adjacent to the diaphragm member 56. Exterior air pressure is generally uniformly exerted upon the outside (concave) face of the diaphragm member 56. This exterior air pressure is now greater than the interior pressure so that the diaphragm member 56 is slightly expanded into the bottle interior, thereby opening the apertures 57. Air passes through the apertures 57 and equalizes the pressure between exterior and interior air.

Figure 12:
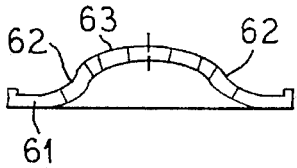
FIG. 12 is a diametrical vertical sectional view taken generally along the line XII—XII of FIG. 11.
Figure 11:
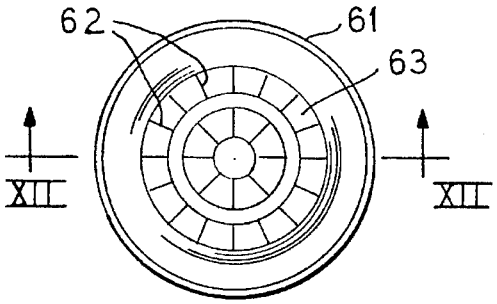
FIG. 11 is a view similar to FIG. 9, but showing an alternative embodiment of the diaphragm member.

Shown in FIGS. 11 and 12 is another embodiment 61 of a diaphragm of this invention that could be employed in bottle structure 54. Diaphragm member 61 has apertures 62 in the form of slits and a domed central portion 63 which is more shallow in depth than, for example, the dome depth of diaphragm member 56.

Figure 13:
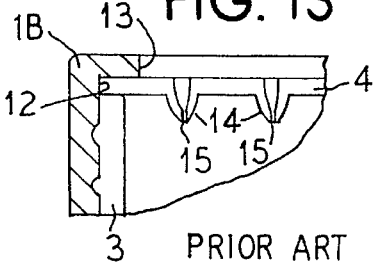
FIG. 13 is a fragmentary axial sectional view through the valved bottom region of a prior art bottle.
Figure 14:
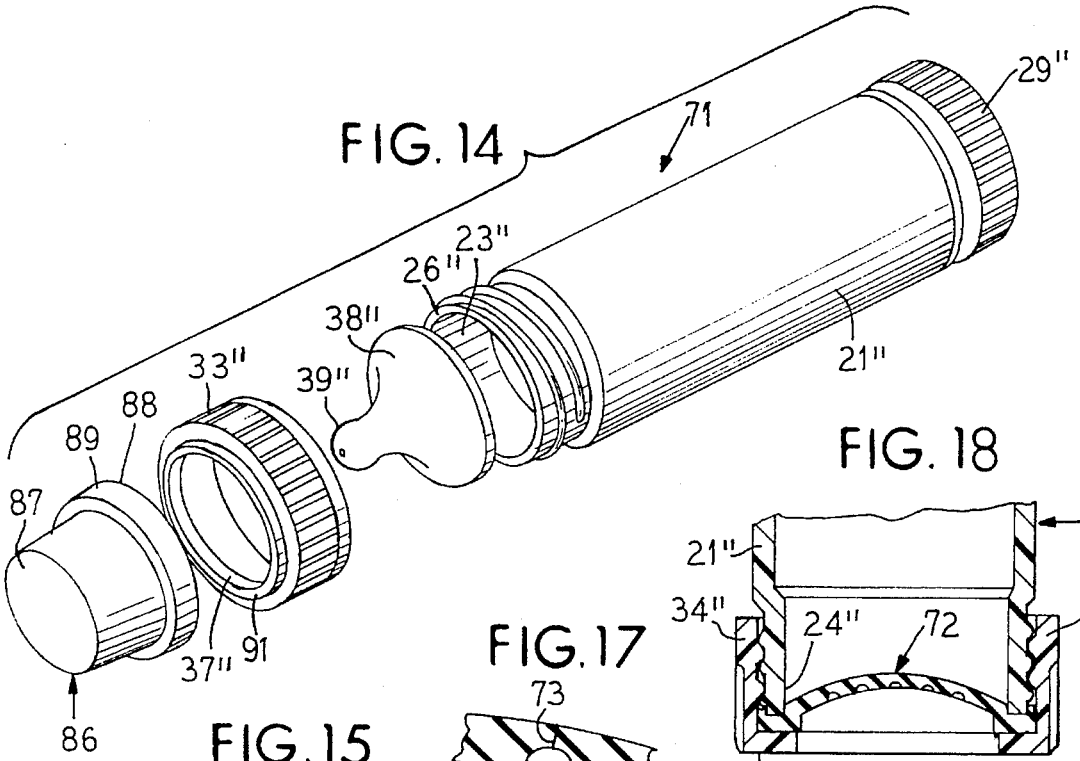
FIG. 14 is a view similar to FIG. 1, but showing a further embodiment of an infant feeding bottle structure of the present invention, this view showing the top end assembly in an exploded form.
Figure 18:
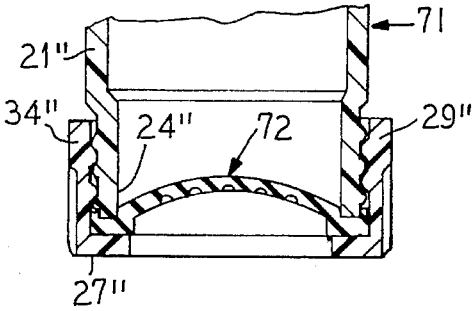
FIG. 18 is a fragmentary enlarged axial sectional view taken through the bottom region of the bottle structure of FIG. 14.
Figure 17:
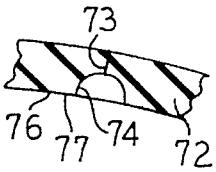
FIG. 17 is an enlarged fragmentary vertical sectional view taken through a single diaphragm aperture in the diaphragm of FIG. 15.
Figure 15:
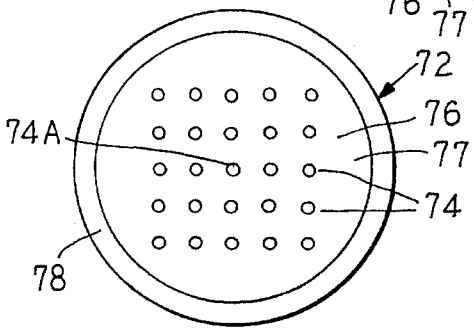
FIG. 15 is an enlarged top plan view of the diaphragm employed in the bottle structure of FIG. 14.

Shown for illustration and comparison purposes in FIG. 13 is a fragmentary view of the bottom region (with the bottle inverted) of the bottle structure disclosed in Chen U.S. Pat. No. 4,685,577 (see particularly FIGS. 3.1 and 3.2 thereof). A lower cap 1B that is threadably associated with nursing bottle 3 retains a penetrating board 4 across a lower bottle opening 12. The penetrating board 4 has a number of cone-shaped air inlet apertures 14. Each aperture 14 is said to be provided at its tip with a pair of check-valve elements 15 (not detailed) which are stated to serve as "a check valve, one-way openable, but tightly closed in the other." The check valve elements 15 are locally responsive to variations in air pressure between the bottle interior and the bottle exterior. Chen teaches that, when the exterior air pressure is greater than the interior air pressure, the valve elements 15 open and air passes therethrough. In contrast to the apertured diaphragm used in the present invention, the Chen air-penetrating board 4 has no functional involvement in the operation of the valve elements 15. In the diaphragm of the present invention, the entire exposed surfaces are pressure responsive and take part in aperture opening and sealed shut closing. The effectiveness of the inventive diaphragm is illustrated by the fact that no funnel-shaped, pressure-regulating member is needed in adjacent relationship to the nipple that is at the bottle end opposite that holding the diaphragm.

Although the apertures 57 and the apertures 43, for example, are shown in their respective Figures as dots for present illustrative purposes, it will be appreciated that in fact these apertures 57 and 43 are in the nature of punctures that extend transversely through their respective diaphragms 56 and 42. When such apertures 57 and 43 are not in an open configuration, but rather are in a closed configuration with their associated diaphragms 56 and 42 relaxed, such apertures 57 and 42 may not be visible to the eye.

FIGS. 14–18 show another embodiment 71 of an infant feeding bottle structure of this invention. Components of bottle structure 71 which are similar in structure and function to corresponding components of bottle structure 20 are similarly numbered, but with the addition of double prime marks thereto for identification purposes. Bottle structure 71 employs an elastic apertured diaphragm 72 in which the individual apertures 73 are illustratively arranged in a square array. Each aperture 73 is a point in configuration when diaphragm 72 is relaxed. Circumferentially about the axis of each aperture 73 a dish-like (preferably hemispherical) recess 74 is located on the concave surface 76 of the domed region 77 of the diaphragm 72.

The diaphragm 72 can have various dimensions. For present illustration purposes, a representative diaphragm 72 has an outside diameter of about 2.09 inches (about 5.31 centimeters), and a domed region 77 configured as a segment of a spherical curvature, the segment has an outside diameter of 1.87 inches (about 4.75 centimeters) and an inside diameter of about 1.75 inches (about 4.44 centimeters). The diaphragm 72 has a square sided rim 78 (i.e., the rim sides meet at about 90° angles) which is about 0.09 inch (about 0.23 centimeters) in axial height. The axial height from the outside face of rim 78 to the outside edge of the segment constituting region 77 is about 0.16 inch (about 0.41 centimeter). Each aperture 73 is formed by straight pin puncture through the diaphragm 72 in the apex region of each hemispherical recess 74. The pin used (not shown) has a circular cross-section. The segment constituting the region 77 has a transverse thickness of about 0.06 inch (about 0.15 centimeter), and each hemispherical recess 74 has a diameter of about 0.06 inch (about 0.15 centimeter) (and a radius of about 0.03 inch or about 0.076 centimeter) with the centers of each of the adjacent recesses 74 being separated from each other by about 0.25 inch (about 0.63 centimeter). Instead of being hemispherical, each recess 74 can be cylindrically or otherwise configured, if desired, as when a diaphragm is thickened or the like. The center recess 74A of the square array can correspond to the location where the forming plastic is injected into a mold during an injection molding procedure used for diaphragm 72 formation. The diaphragm 72 is illustratively comprised of a food grade silicone rubber that is initially liquid and that has a durometer hardness of about 30 after molding. Those skilled in the art will readily appreciate that various diaphragm dimensions, arrangements, compositional materials and the like can be used in a given diaphragm without departing from the spirit and scope of the invention.

Figure 19:
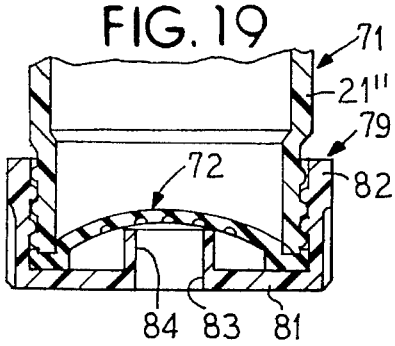
FIG. 19 is a view similar to FIG. 18, but showing an alternative bottom structure.
Figure 16:
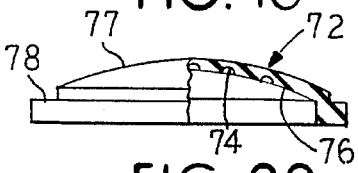
FIG. 16 is a combined side elevational view and diametrical vertical sectional view of the diaphragm of FIG. 15.
Figure 20:
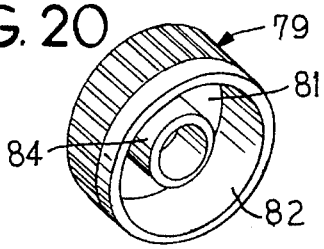
FIG. 20 is a perspective view of the bottom cap structure employed in the bottom structure of FIG. 19.

To provide auxiliary support as a safety measure for the domed region 77 of the diaphragm 72, and thereby maintain the configuration of the dome 77 when, for example, the bottle structure 71 is assembled and substantially filled with liquid infant food, a bottom support cap 79 preferably replaces the cap member 29", in the assembled bottle 71, the cap 79 being as shown in FIGS. 19 and 20. Support cap 79 is conveniently structurally similar to cap 29" except that cap 79 has an integral cover plate portion 81 that is unitarily joined to an internally threaded rim 82. A central axial opening 83 is defined in cover portion 81. Inwardly extending circumferentially about opening 83 is an integrally formed cylindrical column 84. The axial height of column 84 is such that its open remote end (relative to cover portion 81) is adapted to rest against the adjacent portions of the concave surface 76 of diaphragm 72, thereby serving to support diaphragm 72 when the bottle 71 is upright and filled with liquid (not shown). However, when the bottle 71 is inclined and liquid is withdrawn through nipple member 38" the end cap 79 does not hinder the capacity of the diaphragm 72 is to distend inwardly responsive to a pressure reduction in the cavity 22" (relative to environmental or exterior air) as when the filled bottle 71 is being used for infant feeding.

Those skilled in the art will readily appreciate that the structure of a diaphragm-supporting bottle cap can vary widely and that the bottle cap 79 is merely illustrative of one member of such a class of diaphragm supporting bottom caps.

For purposes of permitting a bottle structure 71 to be filled with liquid and then stored (temporarily), as when an infant is to be fed while away from home, the bottle structure 71 can be optionally but preferably provided with a nipple cap 86. Like other components of bottle 71, nipple cap 86 is preferably comprised of molded plastic. The nipple cap 86 is preferably comprised of a relatively rigid, yet somewhat flexible (i.e., not brittle) plastic, such as an acrylate resin or the like, and is conveniently transparent.

The nipple cap 86 is sized so as to fit over the nipple member 38". The inside center face of the end portion 87 of the cap 86 can be adjacent to the terminal area of the nipple 39". When cap 86 is positioned over nipple member 38" the rim 88 of the nipple cap 86 and the portions of the nipple cap side wall 89 that are immediately adjacent thereto are adapted to engage cooperatively and provide a snap fit closure with an upstanding flange 91 that extends about and is integrally formed with the cap member 28" and that is adjacent to the edge of the hole 36" in cap member 28". Thus, the nipple cap 86 is protective and not only maintains the nipple member 38" in a sanitary condition, but also prevents any compression or distortion of the nipple member configuration until the liquid content (or charge) in a bottle structure 71 is used for infant feeding.

For such storage purposes, at the opposite end of the bottle 71, the diaphragm 72 is optionally but preferably provided with a diaphragm protector 92 which is a plate-like structure of molded plastic that is adapted to be nestably received over and adjacent to the concave surface portions of the diaphragm 72. The rim edge portions of the diaphragm protector 92 are configured to overlie the rim 78 of diaphragm 72. Thus, when either the end cap 29" or the end cap 79 is engaged with the housing 21" the rim edge portions of the diaphragm protector 92 are clamped sealingly against the rim 78 of diaphragm 72 thereby protecting the diaphragm 72.

Figure 22:
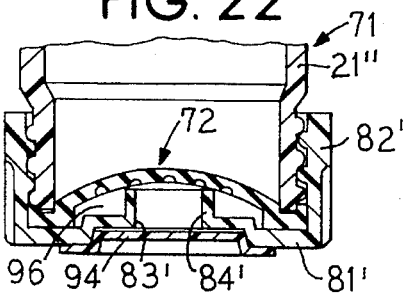
FIG. 22 is a view similar to FIG. 19, but showing this bottom structure in further combination with an exteriorly snap-fitting sealing cap.
Figure 21:
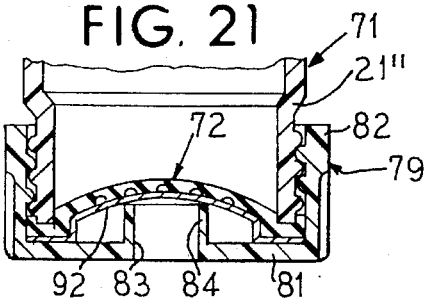
FIG. 21 is a view similar to FIG. 19, but showing this bottom structure in further combination with an auxiliary non-apertured supporting diaphragm.

Alternatively, if desired, the cap 79 can be replaced by a cap 93 as shown in FIG. 22. Cover or cap 93 is similar in structure and function to cap 79 and corresponding parts are similarly numbered but with the addition of prime marks thereto for identification purposes. However, bottom cap 93 is provided in its cover portion 81' with a recessed region 96 located at a mid-region between the rim 82' and the opening 83'. A removable flattened cover plate 94 is seatable about the edge portions of the recess 96 in a snap fit arrangement. The plate can be provided with a recessed tab or the like which is graspable between the thumb and forefinger and which can thus be used to provide the leverage to disengage the cover plate 94 from the cap 93 before use.

Various other and further embodiments, applications, structures and the like will be apparent to those skilled in the art from the description provided herein and no undue limitations are to be implied or inferred therefrom.

What is claimed is:

1. A bottle for feeding a liquid to an infant and the like comprising in combination:

(a) a walled housing defining therewithin a cavity having an opening defined at each one of a pair of opposed ends with each opening having an adjacent cylindrically configured circumferentially extending threaded lip region;

(b) two cap members, each said cap member having a circumferentially extending rim and an associated threaded rim adjacent portion that is threadably matingly engagable with a different respective one of said threaded lip regions, and each said cap member having cap associated means for sealing engagement with the adjacent said lip region when each said cap member is fully threadably engaged with each said so engaged said lip region, and each said cap member having a hole defined generally in a mid-region thereof;

(c) a nipple member positionable at one said opening and having an outwardly extending nipple and circumferential edge portions that are sealingly associatable with portions of one said one cap members adjacent said hole thereof when said one cap member is so fully threadably engaged with said threaded lip region adjacent said one opening; and (d) a thickened elastomeric diaphragm member positionable at the other said opening, said diaphragm member having a dome configured central portion with opposed concave and convex faces, said diaphragm member having a plurality of discrete apertures defined in said central portion, each said aperture being defined by aperture adjacent regions of said diaphragm member, said apertures individually being in a sealed shut configuration when said diaphragm member is relaxed and being in an open configuration when said diaphragm member is expanded responsive to applied gas pressure, said apertures when in their respective said sealed shut configurations being closed by said aperture adjacent regions of said diaphragm member, said concave face having a dish-like depression defined therein centrally at each one of said apertures, said diaphragm member having circumferential edge portions that are sealingly associatable with portions of the other of said cap members adjacent said hole thereof when said other cap member is so fully threadably engaged with said threaded lip region adjacent said other opening, and said diaphragm member also having said plurality of said apertures positioned so that air can pass through said hole in said other cap member to each of said apertures;

whereby, when said bottle is upright and said apertures are in their respective said sealed shut configurations, said liquid in said bottle is retained by said diaphragm member, and when said bottle is inverted and said liquid is being withdrawn from said bottle through said nipple member, said apertures are in their respective said open configurations and gas passes through said apertures into said bottle.

2. The bottle of claim 1 wherein said circumferential edge portions of said nipple member seat within said one cap member and said nipple member extends through said hole thereof.

3. The bottle of claim 1 wherein said circumferential edge portions of said nipple member include said means for sealing engagement of said one cap member relative to said adjacent said threaded lip region.

4. The bottle of claim 1 wherein said circumferential edge portions of said diaphragm member seat within said other cap member with said diaphragm member being oriented so that said central portion is externally concave.

5. The bottle of claim 1 wherein said circumferential edge portions of said diaphragm member include said means for sealing engagement of said other cap member relative to said adjacent said threaded lip region.

6. The bottle of claim 1 wherein said housing is axially elongated, wherein said openings are about equal in size and each one of said cap members is interchangeably threadably matingly engagable with each one of said threaded lip regions, and wherein said rim portion of each one of said cap members is internally so threaded and each said lip region is externally matingly so threaded.

7. The bottle of claim 1 wherein said apertures have a slit-like configuration.

8. The bottle of claim 1 wherein each of said housing, said cap members, said nipple member, and said diaphragm member is separatable from the others thereof.

9. The bottle of claim 1 wherein each of said housing, said cap member, said nipple member and said diaphragm member is sterilizable by boiling water.

10. The bottle of claim 1 wherein each of said housing, said cap member, said nipple member and said diaphragm member is comprised of plastic.

11. The bottle of claim 1 wherein said diaphragm member is comprised of a silicone elastomer.

12. The bottle of claim 1 wherein said diaphragm member is further provided with a peripheral axially extending unitary flange for extending over circumferential edge portions of the adjacent one of said openings.

13. The bottle of claim 1 wherein said one cap member is provided with a releasable nipple protective cap that is removed from said bottle before said bottle is used for feeding.

14. The bottle of claim 1 wherein said diaphragm member is provided with protective relative rigid plate structure that is interposable between said diaphragm member and said other cap member and which is removed from said bottle before said bottle is used for feeding.

15. The bottle of claim 1 wherein said other cap member is provided with a central aperture and with a releasable sealingly associatable end cap that is removed from said bottle before said bottle is used for feeding.

16. As an article of manufacture, a thickened elastomeric diaphragm member having a dome-configured central portion with opposed concave and convex faces and circumferential, generally flattened edge portions, said central portion having defined therein a plurality of apertures that are in a sealed shut configuration when said diaphragm member is relaxed and are in an open configuration when said diaphragm member is expanded responsive to gas pressure applied against said concave face, said concave face having a dish-like depression defined therein centrally at each one of said apertures, whereby said diaphragm member acts as a gas pressure responsive check valve.

17. A process for equalizing gas pressure in the interior gas space of an oriented container relative to exterior gas pressure as liquid in said oriented container is being withdrawn through a discharge aperture of said container, this process comprising the steps of:

(a) preliminarily associating a thickened elastomeric diaphragm member with said container in a region thereof that is adjacent to said interior gas space when said container is so oriented, said diaphragm member relative to said container being externally concave, said diaphragm member having a dome-configured central portion with opposed concave and convex faces and circumferential, generally flattened edge portions, said central portion having defined therein a plurality of apertures that are in a sealed shut configuration when said diaphragm member is relaxed and are in an open configuration when said diaphragm member is expanded responsive to gas pressure applied against said concave face, said concave face having a dish-like depression defined therein centrally at each one of said apertures, whereby said diaphragm member acts as a gas pressure responsive check valve, and, thereafter, (b) so orienting said container and so withdrawing said liquid, whereby said exterior gas passes through said openings and so equalizes said interior gas pressure relative to said exterior gas pressure.

18. A bottle for feeding a liquid to an infant and the like comprising in combination:

(a) a walled housing defining therewithin a cavity having an opening defined at each one of a pair of opposed ends with each opening having an adjacent cylindrically configured circumferentially extending threaded lip region;

(b) two cap members, each said cap member having a circumferentially extending rim and an associated threaded rim adjacent portion that is threadably matingly engagable with a different respective one of said threaded lip regions, and each said cap member having cap associated means for sealing engagement with the adjacent said lip region when each said cap member is fully threadably engaged with each said so engaged lip region, and each said cap member having a hole defined generally in a mid-region thereof;

(c) a nipple member positionable at one said opening and having an outwardly extending nipple and circumferential edge portions that are sealingly associatable with portions of one said one cap members adjacent said hole thereof when said one cap member is fully threadably engaged with said threaded lip region adjacent said one opening;

(d) a thickened elastomeric diaphragm member positionable at the other said opening, said diaphragm member having a plurality of discrete apertures defined therein, each said aperture being defined by aperture adjacent regions of said diaphragm member, said apertures individually being in a sealed shut configuration when said diaphragm member is relaxed and being in an open configuration when said diaphragm member is expanded responsive to applied gas pressure, said apertures when in their respective said sealed shut configurations being closed by said aperture adjacent regions of said diaphragm member, said diaphragm member having circumferential edge portions that are sealingly associatable with portions of the other of said cap members adjacent said hole thereof when said other cap member is fully threadably engaged with said threaded lip region adjacent said other opening, and said diaphragm member also having said plurality of said apertures positioned so that air can pass through said hole in said other cap member to each of said apertures; and (e) said other cap member including diaphragm support means for said diaphragm member and also a cylindrical axially extending support column for said diaphragm member;

whereby, when said bottle is upright and said apertures are in their respective said sealed shut configurations, said liquid in said bottle is retained by said diaphragm member, and when said bottle is inverted and said liquid is being withdrawn from said bottle through said nipple member, said apertures are in their respective said open configurations and gas passes through said apertures into said bottle.

* * * * *